US010238906B1

(12) United States Patent
Doyle

(10) Patent No.: US 10,238,906 B1
(45) Date of Patent: Mar. 26, 2019

(54) GLUTEUS MAXIMUS EXERCISE DEVICE

(71) Applicant: Dennis Doyle, Santa Monica, CA (US)

(72) Inventor: Dennis Doyle, Santa Monica, CA (US)

( * ) Notice: Subject to any disclaimer, the term of this patent is extended or adjusted under 35 U.S.C. 154(b) by 39 days.

(21) Appl. No.: 16/019,870

(22) Filed: Jun. 27, 2018

Related U.S. Application Data

(60) Provisional application No. 62/526,698, filed on Jun. 29, 2017.

(51) Int. Cl.

| | |
|---|---|
| ***A63B 21/008*** | (2006.01) |
| ***A63B 21/00*** | (2006.01) |
| *A63B 23/035* | (2006.01) |
| *A63B 21/16* | (2006.01) |

(52) U.S. Cl.
CPC .... *A63B 21/0085* (2013.01); *A63B 21/00069* (2013.01); *A63B 21/008* (2013.01); *A63B 21/00047* (2013.01); *A63B 21/00058* (2013.01); *A63B 21/16* (2013.01); *A63B 21/169* (2015.10); *A63B 21/1681* (2013.01); *A63B 23/03508* (2013.01)

(58) Field of Classification Search
CPC ..... A63B 21/0085; A63B 21/00069; A63B 21/169; A63B 21/00047; A63B 21/00058; A63B 21/61; A63B 21/1681; A63B 23/03508; A63B 5/08; A63B 5/12; A63B 5/16
See application file for complete search history.

(56) References Cited

U.S. PATENT DOCUMENTS

| | | | | |
|---|---|---|---|---|
| 4,248,421 | A * | 2/1981 | Salazar | A63B 21/0085 482/112 |
| 4,635,931 | A | 1/1987 | Braennstam | |
| 5,256,118 | A * | 10/1993 | Chen | A63B 22/0056 482/112 |
| 8,007,417 | B2 | 8/2011 | Heller | |
| 8,246,522 | B2 | 8/2012 | Piaget et al. | |
| 2010/0285931 | A1* | 11/2010 | Heller | A63B 22/18 482/92 |
| 2011/0195822 | A1* | 8/2011 | Donofrio | A63B 1/00 482/93 |
| 2015/0375034 | A1* | 12/2015 | Babon | A63B 21/1636 482/130 |

FOREIGN PATENT DOCUMENTS

| | | |
|---|---|---|
| WO | WO95/20997 | 8/1999 |

OTHER PUBLICATIONS

Amazon.com—Intex Giant Bellows Foot Pump, 12.5". Sports & Outdoors. May 8, 2018, 9 pages.

* cited by examiner

*Primary Examiner* — Megan Anderson
(74) *Attorney, Agent, or Firm* — Joseph E. Maenner; Maenner & Associates, LLC

(57) ABSTRACT

An exercise device for targeting the gluteus maximus muscle uses a stand to hold up a bellows pump against a vertical surface while a user repeatedly pushes the pump with a foot. The pump has a one-way inlet valve and a small restrictor opening to allow air to leave the bellows slowly, providing a mechanism for selecting different resistance values. A catch is used to keep the pump in the compressed position during storage.

12 Claims, 12 Drawing Sheets

GLUTEUS MAXIMUS EXERCISE DEVICE

CROSS-REFERENCE TO RELATED APPLICATION

The present invention claims priority from U.S. Provisional Patent application Ser. No. 62/526,698, filed on Jun. 29, 2017, which is incorporated herein by reference in its entirety.

BACKGROUND OF THE INVENTION

Field of the Invention

The present invention relates to exercise equipment. Specifically, the present invention is a device that facilitates targeted exercise of the gluteus maximus muscles.

Description of the Related Art

Exercise is key for the health of an individual. There are many different muscles in the human body and a number of different workouts that target each muscle. However, workouts typically do not target a specific muscle, but rather a group of different muscles. Workouts that target the gluteus maximus often exercise other leg muscles more. There exists a need for an invention that can target the gluteus maximus where the gluteus maximus is the main muscle of focus.

SUMMARY OF THE INVENTION

This summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is an exercise device that allows a person to focus their exercise efforts on the gluteus maximus muscles. The device holds a modified air pump in position against a wall or other vertical surface while a user presses on the pump with a foot from various positions. The pump is modified with an insert that restricts the flow of air with selectable resistance to provide an adjustable level of exercise intensity. The device also contains a clasp for holding the exercise device in a depressed position so that the device remains depressed for convenient storage.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
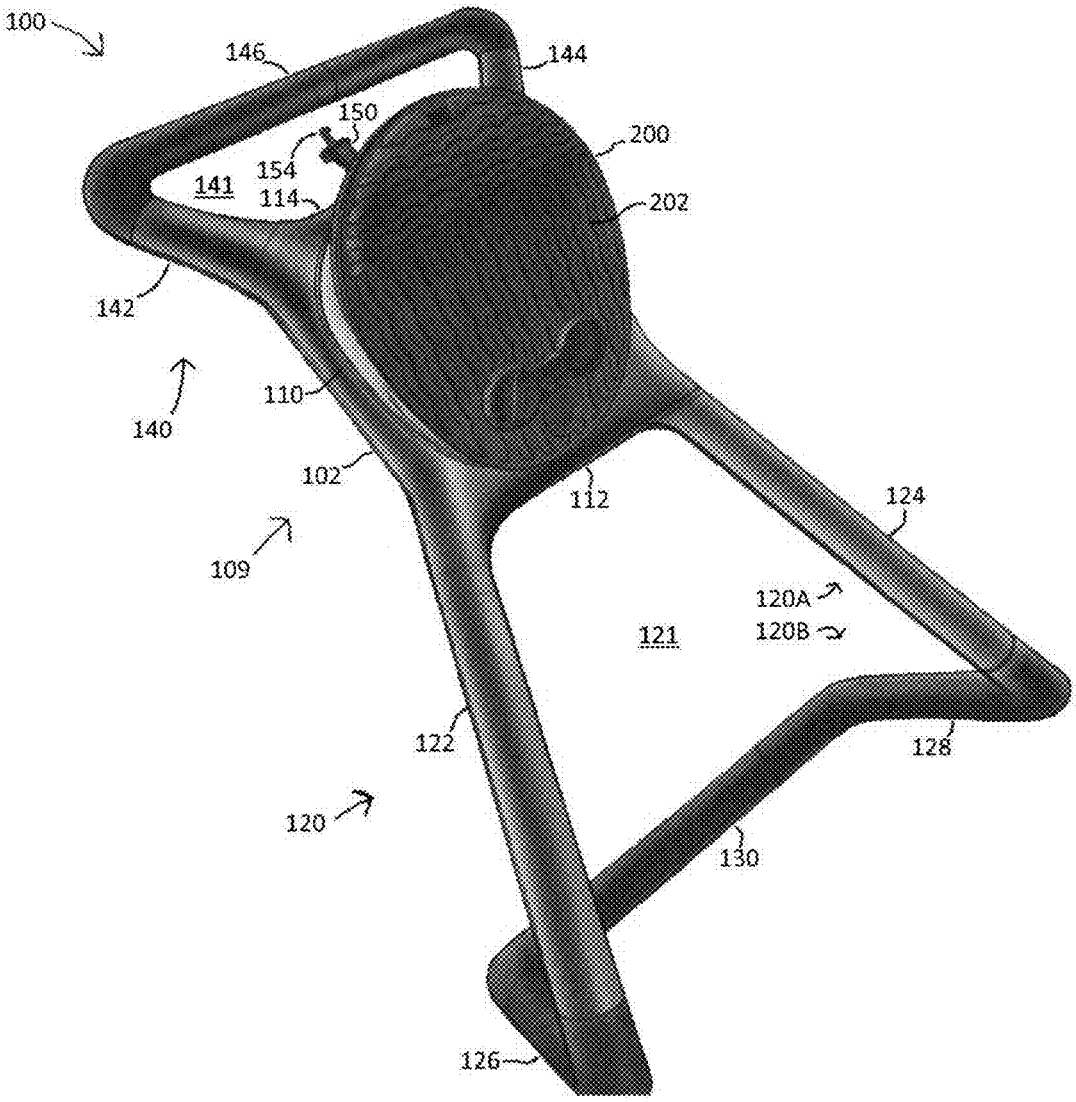
FIG. 1 is a perspective view of an exemplary embodiment of an exercise device according to the present invention.
Figure 2:
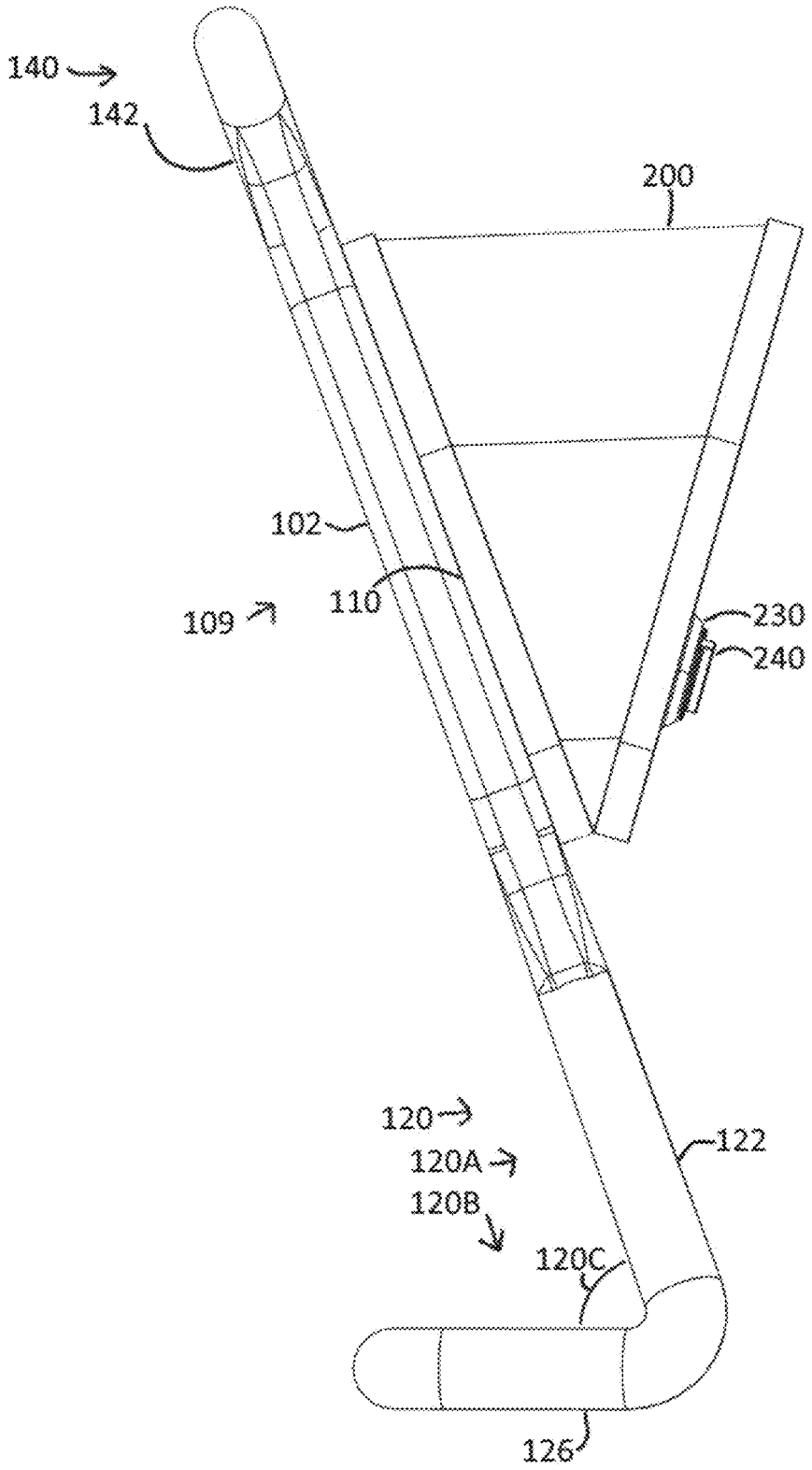
FIG. 2 is a left side view of the exercise device of FIG. 1.
Figure 3:
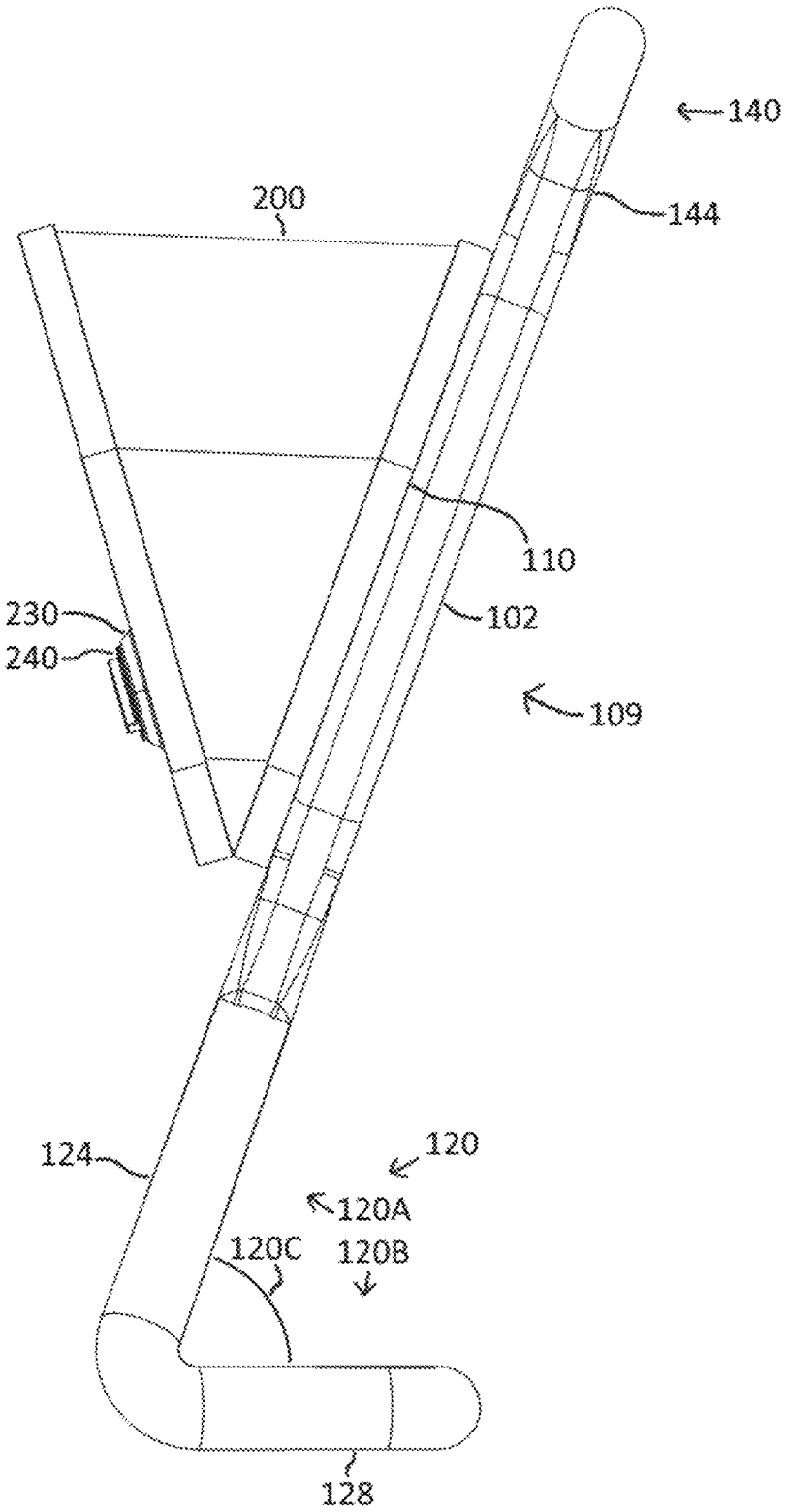
FIG. 3 is a right side view of the exercise device of FIG. 1.
Figure 4:
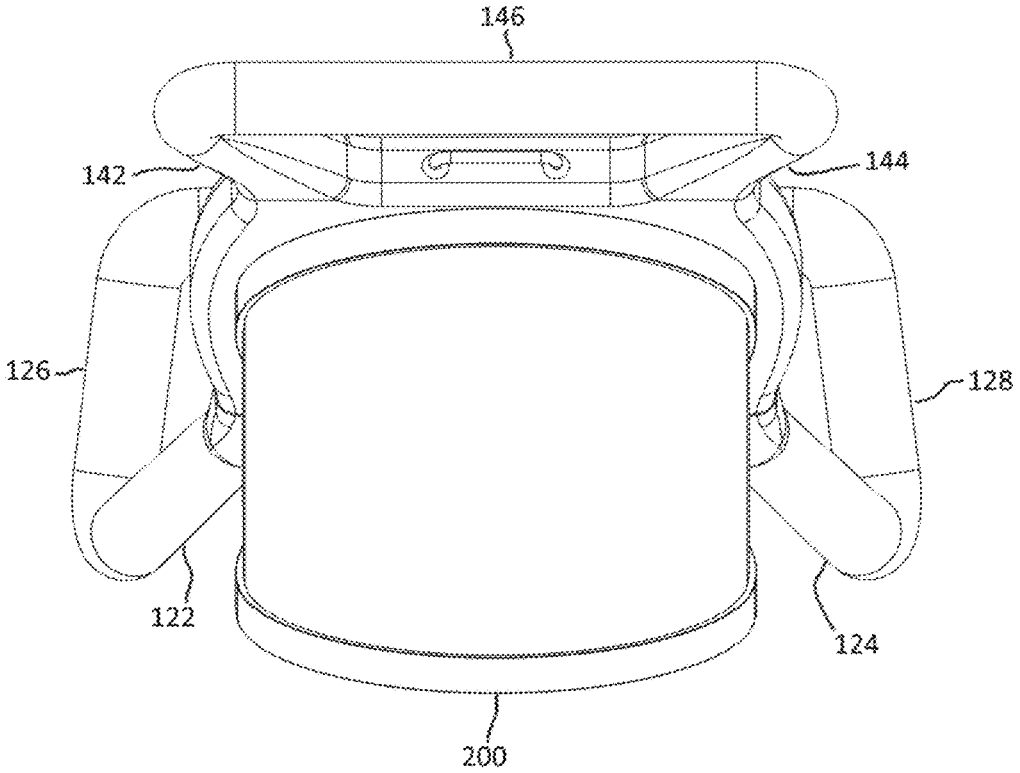
FIG. 4 is a top plan view of the exercise device of FIG. 1.
Figure 5:
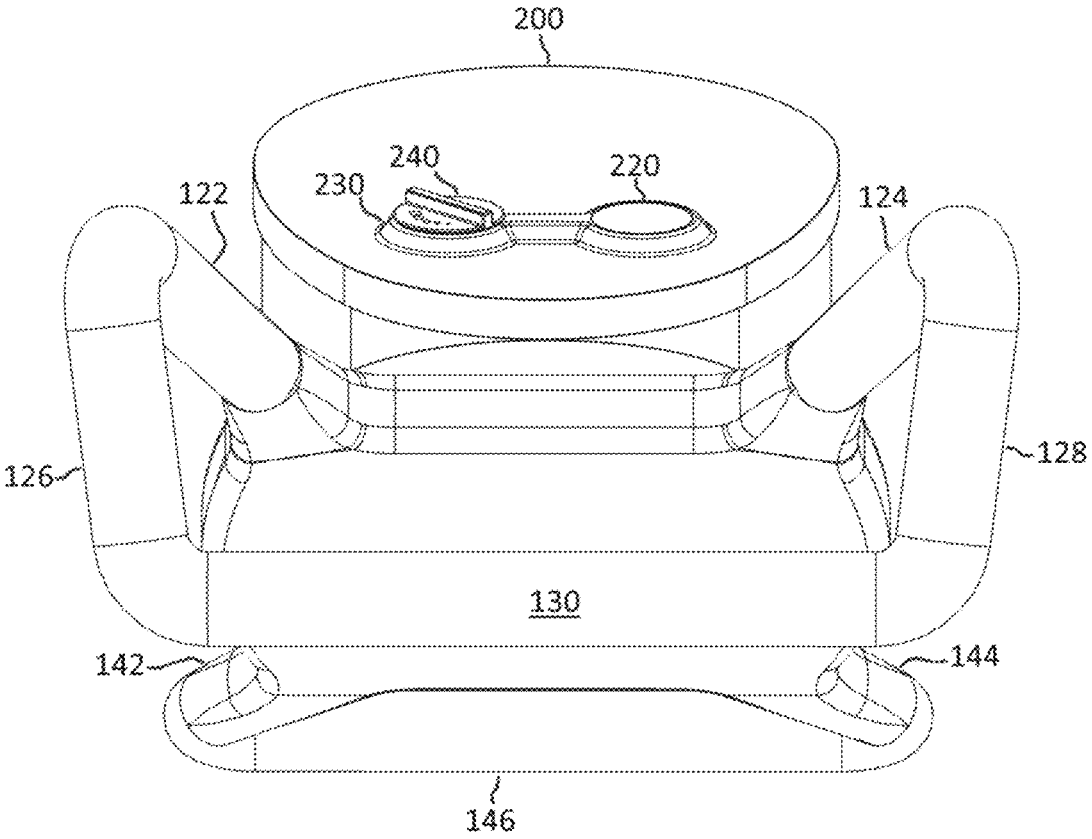
FIG. 5 is a bottom plan view of the exercise device of FIG. 1.
Figure 6:
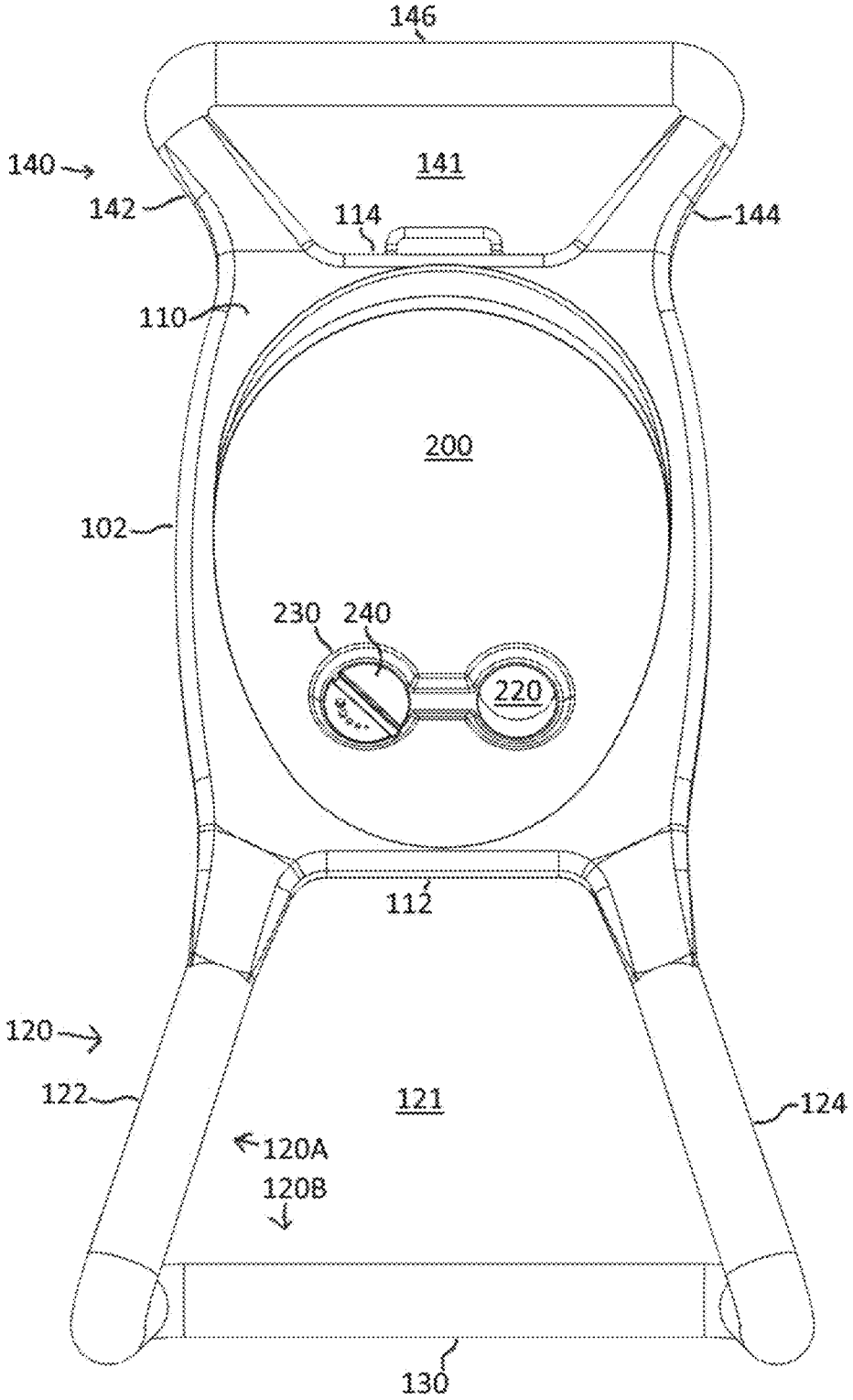
FIG. 6 is a front elevational view of the exercise device of FIG. 1.
Figure 7:
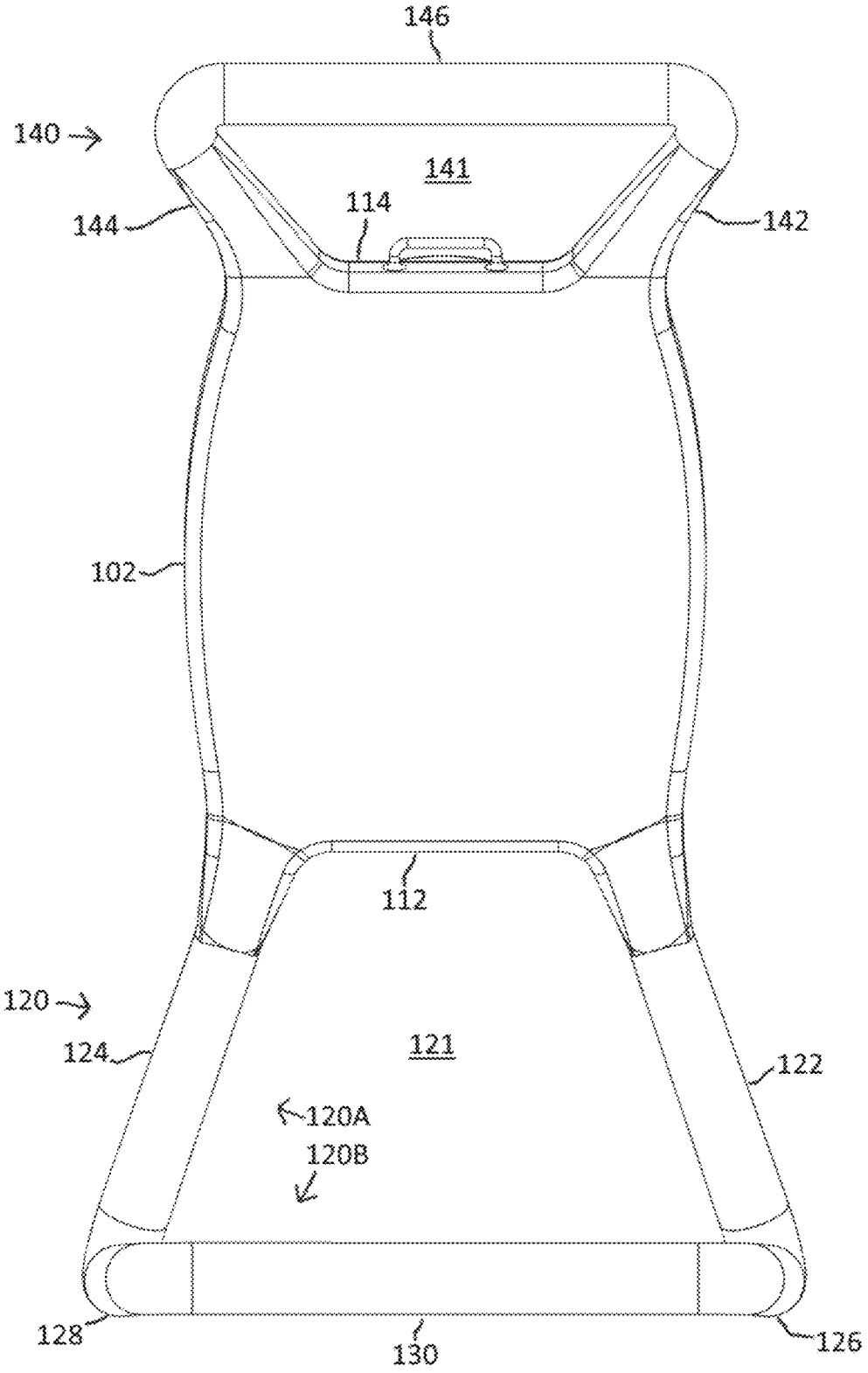
FIG. 7 is a rear elevational view of the exercise device of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "distal" is defined as a distance away from a device's center, and the term "proximal" is defined as a distance close to the device's center.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Referring to FIG. 1-8, an exemplary embodiment of an exercise device 100 according to the present invention is shown. The exercise device 100 includes a stand 102 with a generally planar body 109 having an attachment face 110 and a central longitudinal axis 104. A mechanical resistance device in the form of a bellows 200 is attached to the attachment face 110.

The longitudinal axis 104 intersects a body first side 112 and a body second side 114. On the first side 112, the body 109 is supported by an attached base 120. The base 120 extends away from the body 109, generally parallel to the attachment face 110. The base 120 is bent, forming a proximal section 120A and a distal section 120B connected at an acute angle 120C. In an exemplary embodiment, angle 120C can be 70 degrees, although those skilled in the art will recognize that angle 120C can be other values. The stand 120 can include a void 121 formed therein, with the residual material forming a first proximal leg 122 connected at the angle 120C to a first distal arm 126, and a second proximal leg 124 connected at the angle 120C to a second distal arm 128. The proximal legs 122, 124 extend generally co-planar with the body 109. The first distal arm 126 is connected to the second distal arm 128 by a connector piece 130 wherein the first distal arm 126, the second distal arm 128, and the connector piece 130 form a generally U-shaped connector portion.

An extension 140 is attached to the second side 114 of the body 109 and extends generally coplanar to the attachment face 110. The extension 140 can include a void 141, with the residual material forming a first extension arm 142 and a second extension arm 144 connected to each other by a handle 146.

The distal section 120B has a length which is long enough to allow the exercise device 100 to rest upright on the stand 120, but short such that, when the handle 146 engages a vertical surface, the connector piece 130 is spaced away from the vertical surface.

Figure 11:
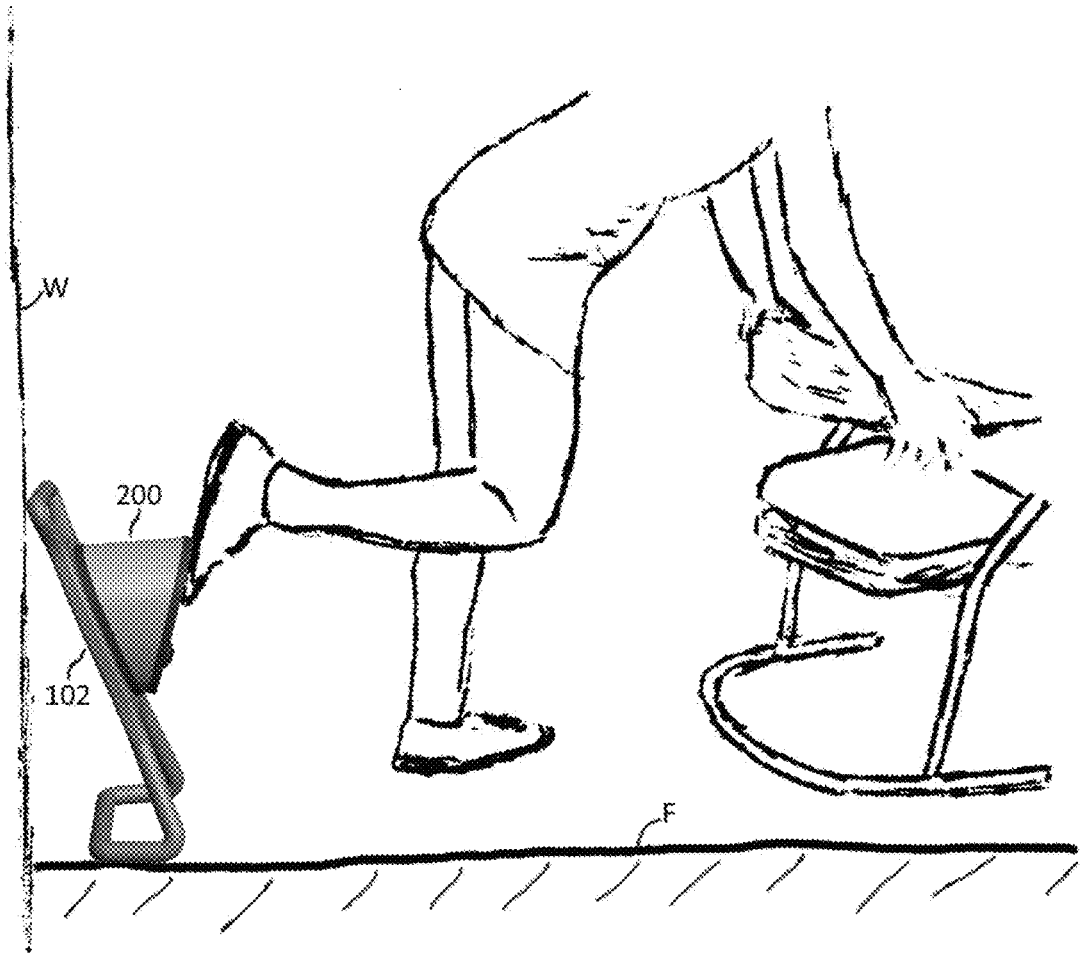
FIG. 11 shows a person using the exercise device of FIG. 1 while standing.
Figure 12:
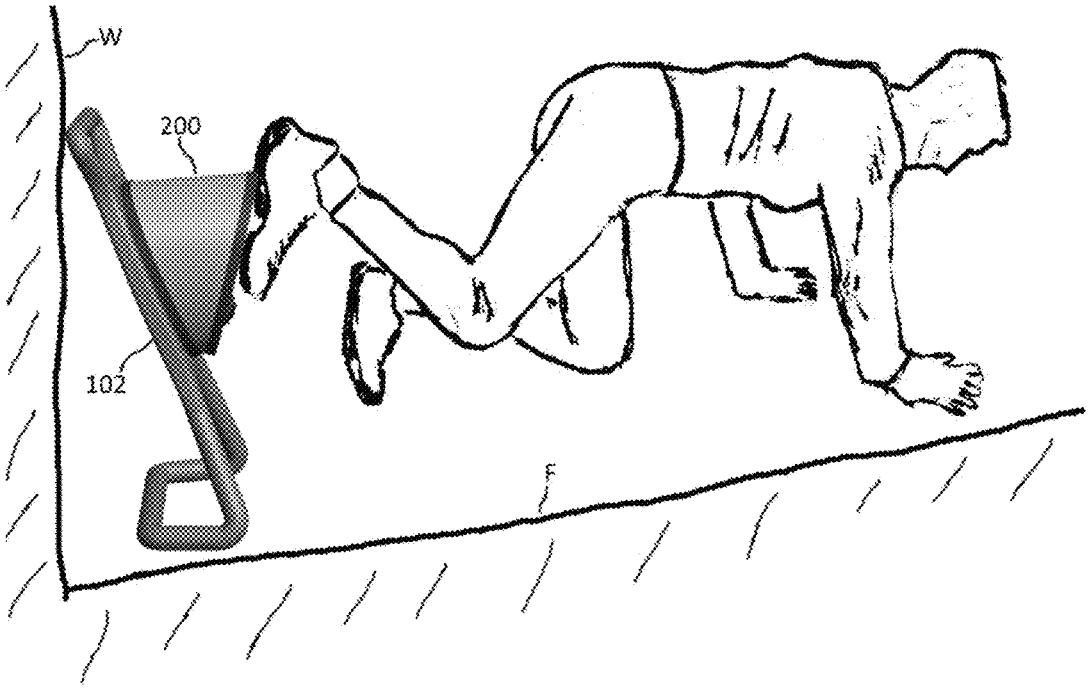
FIG. 12 shows a person using the exercise device of FIG. 1 while crouched.
Figure 13:
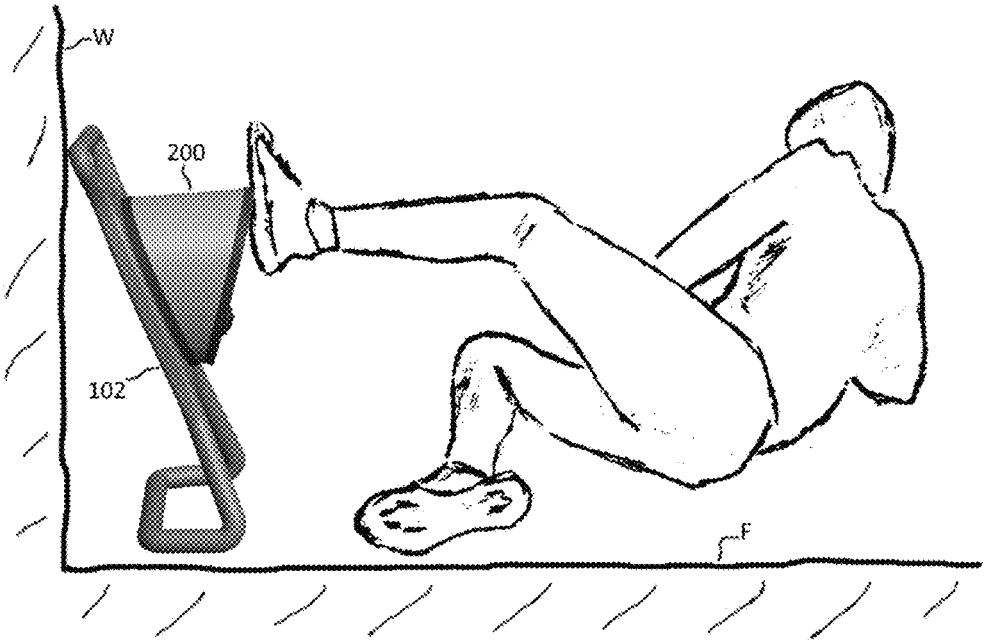
FIG. 13 shows a person using the exercise device of FIG. 1 while laying down.

Thus, as shown in FIG. 11-13, the exercise device 100 can be placed on a floor "F" and rested securely against a vertical surface, such as a wall "W" with the handle 146 in contact with the wall W to prevent movement of the device 100 while in use as a person pushes against the exercise device 100.

A non-skid material, such as for example, rubber, can be affixed to the stand 120 and to the extension 140 to increase frictional resistance of device 100 with respect to the floor F and the wall W to reduce the likelihood of device 100 slipping while in use.

Figure 8:
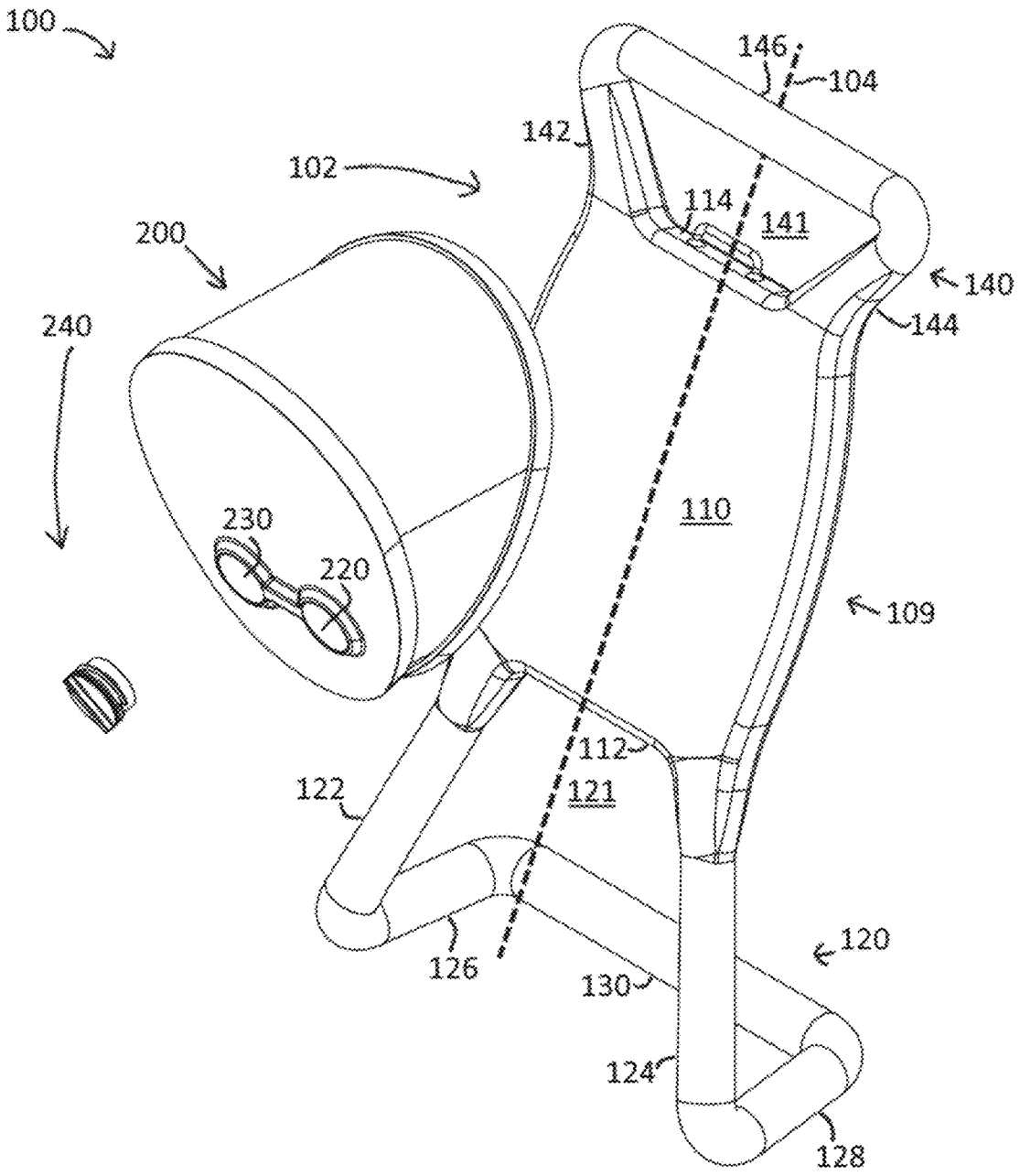
FIG. 8 is an exploded perspective view of the exercise device of FIG. 1.
Figure 9:
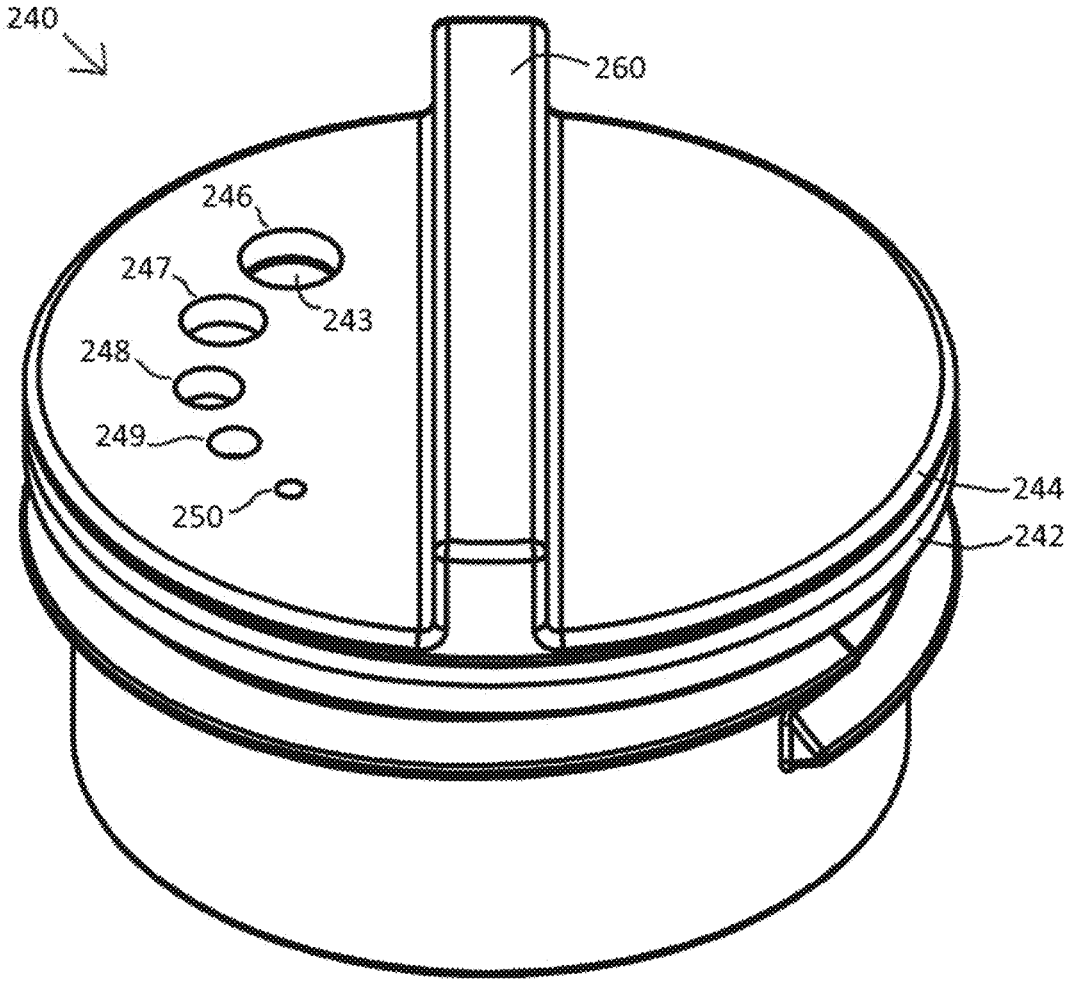
FIG. 9 is a perspective view of a plug and cap used with the exercise device of FIG. 1.

Foot-operated bellows pumps are known and are sold at retail stores for inflating various sporting equipment. One such pump having a one-way inlet valve 220 and an output hole 230 can be used with device 100 and is retrofitted as follows:

A 2-way flow restrictor 240, detailed in FIG. 9, is inserted into the output hole 230 (shown in FIG. 8). The flow restrictor 240 comprises a plug 242 and a cap 244. The plug 242 is formed with a plug hole 243 that allows for the flow of fluid out of the bellows pump 200 as the bellows pump 200 is depressed. The plug hole 243 is sized to provide a minimum desired flow resistance.

The cap 244 is rotatably connected to the plug 242 and a plurality of cap holes 246-250 are formed radially around the cap 244. As the cap 244 is rotated, each cap hole 246-250 can be made to align with the plug hole 243 and provide a path for fluid to pass out of the bellows pump 200 with a resistance inversely proportional to the size of the aligned cap hole 246-250. A protrusion 260 is formed on the cap 244 which allows a person to manually grasp and turn the cap 244 to select the desired resistance.

While a plug 242 and cap 244 combination are used to retrofit an existing bellows pump 200, those skilled in the art will readily recognize that a bellows pump 200 can be provided with the cap 244 already provided, as described, covering an opening 230 in the bellows pump 200.

Figure 10:
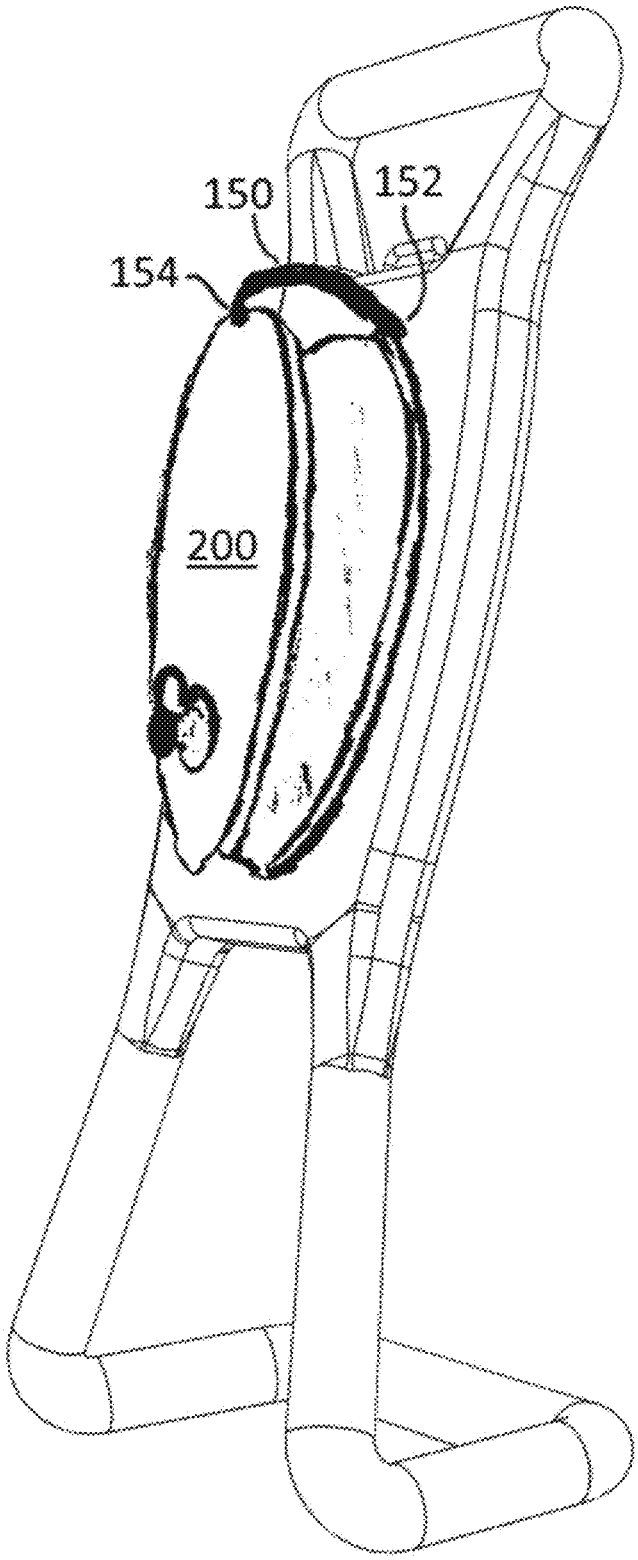
FIG. 10 is a perspective view of exercise device of FIG. 1 showing a clasp used to restrain a bellows of the device in a compressed state.

Referring to FIG. 1 and FIG. 10, a clasp 150 is provided. The clasp 150 includes a first end 152 attached to the body 109 and a second end 154 adapted to releasably engage the bellows pump 200 in a depressed position. When a user is finished exercising, the user depresses the bellows pump 200, pulls the hooked end 154 of the clasp 150 over the bellows pump 200, and releases the bellows pump 200. The hooked end 154 retains the bellows pump 200 in the depressed position so that less storage space is needed.

A non-skid material 202 (shown in FIG. 1) can be applied to the face of the bellows pump 200 to improve traction when a user engages the device 100 with a foot.

As demonstrated in FIG. 11-13, the exercise device 100 can be placed against the wall W and used from various positions, including a standing position (FIG. 11), a crouched position (FIG. 12), or a laying position (FIG. 13). With the exercise device 100 leaned against the wall W, the user places a foot on the bellows pump 200 and depresses the bellows pump 200, then releases the bellows pump 200. This motion is repeated as desired.

It will be further understood that various changes in the details, materials, and arrangements of the parts which have been described and illustrated in order to explain the nature of this invention may be made by those skilled in the art without departing from the scope of the invention as expressed in the following claims.

I claim:

1. An exercise device comprising:

(a) a base adapted to rest on a floor;

(b) a body having an attachment face, a first side and a second side, the body being fixedly connected to the base at the first side;

(c) an extension fixedly connected to the second side of the body, the extension adapted to rest against a vertical surface; and (d) a bellows pump having a valve means attached to the attachment face.

2. The exercise device according to claim 1 wherein the valve means is built into the bellows pump whereby fluid within the bellows pump is in limited fluid communication with fluid outside the bellows pump.

3. The exercise device according to claim 2 wherein the valve means comprises a one-way inward valve and a two-way flow restrictor.

4. The exercise device according to claim 3 wherein the two-way flow restrictor comprises a through opening formed in the bellows pump and a plug inserted into the through opening, the plug having a face formed with a plug hole sized to provide a minimum desired fluid flow resistance.

5. The exercise device according to claim 4 further comprising a cap rotatably attached to the plug, the cap being formed with a plurality of cap holes spaced radially around the cap, whereby each of the plurality of cap holes is configured to align with the plug hole as the cap is rotated relative to the plug, whereby less resistance to fluid flow is produced by alignment with a first of the plurality of cap holes and more resistance is produced by alignment with a second of the plurality of cap holes.

6. The exercise device according to claim 5, further comprising a protrusion extending outwardly from the cap.

7. The exercise device according to claim 1 wherein the base comprises a proximal section attached to and extending away from the body generally coplanar to the attachment face, and a distal section, having a length, fixedly attached to the proximal section at an angle, angled away from the bellows pump, the length and the angle suitable to allow the exercise device to extend upwardly while resting on the distal section.

8. The exercise device according to claim 7 wherein the length of the distal section of the base is not long enough to cause interference between the base and the vertical surface when the exercise device is resting on the distal section and placed next to the vertical surface with the bellows pump facing away from the vertical surface.

9. The exercise device according to claim 1 wherein the extension has a void formed therein.

10. The exercise device according to claim 9 further comprising a non-skid material on the extension and on the base.

11. The exercise device according to claim 1 wherein the base has a void formed therein.

12. The exercise device according to claim 1 further comprising the clasp having a first end attached to the body and a second end having a hook adapted to releasably engage the bellows pump while the bellows pump is depressed, whereby the exercise device remains depressed.

* * * * *